United States Patent [19]

Owen

[11] Patent Number: 4,897,948

[45] Date of Patent: Feb. 6, 1990

[54] DISPLAY SYSTEMS

[76] Inventor: Gordon Owen, 48 Milton Dr., Ravenshead, Nottingham, England

[21] Appl. No.: 98,273

[22] Filed: Sep. 18, 1987

[51] Int. Cl.[4] ..... G09F 3/18

[52] U.S. Cl. ..... 40/661; 40/152; 206/45.34

[58] Field of Search ..... 40/124.2, 124, 486, 40/590, 605, 610, 661; 446/69, 117, 79, 85; 206/45.34

[56] References Cited

U.S. PATENT DOCUMENTS

| | | | |
|---|---|---|---|
| 243,362 | 6/1881 | Crandall | 446/69 |
| 2,131,349 | 9/1938 | Kreider | 446/117 |
| 2,235,801 | 3/1941 | Herlihy | 446/69 |
| 2,278,894 | 4/1942 | Paulson | 446/117 |
| 2,401,478 | 6/1946 | Grossman | 40/598 |
| 3,407,514 | 10/1968 | Christian | 446/69 |
| 3,601,916 | 8/1971 | Epstein | 40/610 |
| 3,716,936 | 2/1973 | Miller | 40/152 |
| 3,797,149 | 3/1974 | Morrison | 40/124.2 |
| 4,055,010 | 10/1977 | Fridlund | 40/124 |
| 4,245,414 | 1/1981 | Shypula | 40/124 |
| 4,505,059 | 3/1985 | Morris | 40/661 |
| 4,566,211 | 1/1986 | Gustafson et al. | 40/605 |
| 4,608,773 | 9/1986 | White | 40/152.1 |
| 4,839,976 | 6/1989 | Kyler | 40/124.2 |

*Primary Examiner*—Gene Mancene
*Assistant Examiner*—Michael Lynch
*Attorney, Agent, or Firm*—Bachman & LaPointe

[57] ABSTRACT

Information is displayed in a stacked series of tubes of diminishing sizes that fit within each other, each tube being removable to allow the information held by the tube to be read separately. The system allows information to be displayed in a compact manner and is suitable for standing on tables etc.

15 Claims, 2 Drawing Sheets

DISPLAY SYSTEMS

The present invention relates to display systems and more particularly to display systems for displaying information relating to a service for the public.

An example of such a display system is in the display of a menu for a restaurant or other type of eating establishment. A first known menu comprises a book form which displays on the leaves of the book the various dishes. A problem with this type of menu is that it is difficult to place on a table. If placed flat then it is not easily seen and takes up a fairly large space and if spaced upright it tends to fall over.

A second known type comprises a base with a slot into which a card (for the day) is inserted. Though taking up less room and not easily falling over the card is not capable, unless it is very large, of carrying much information and therefore a large variety of dishes or drinks cannot be readily offered to the customer.

It is an object of the present invention to provide a display system for providing information to a customer which is compact, is able to stand freely and with stability on a table and which contains information which is readily read by a customer.

The present invention therefore provides a display system for the display of information to a customer including a first hollow box section tube fixed to a base and including at least one further box section tube of smaller cross-section fitted within the first hollow box section tube to be readily removable therefrom and in which information relating to a customer's requirements is displayed on at least one face of each of the tubes.

Preferably within the first hollow box section tube there are provided second and third further box section tubes, the second tube being sized to fit within the first tube and the third tube being sized to fit within the second tube. Preferably either of the second or third tubes may be removed from within the first tube without disturbing the other.

Preferably the tubes are of rectangular cross-section and more preferably of square cross-section.

Alternatively the tubes may be of hexagonal cross-section. The hexagon may be irregular with four broad faces and four interconnecting narrow faces.

The faces of the tubes are preferably completely covered with information relating to the customers requirements. Alternatively one or more of the faces of the tubes may be provided with means for holding temporarily information relating to recent changes.

Embodiments of the present invention will now be described by way of example with reference to the accompanying drawings in which.

Figure 7:
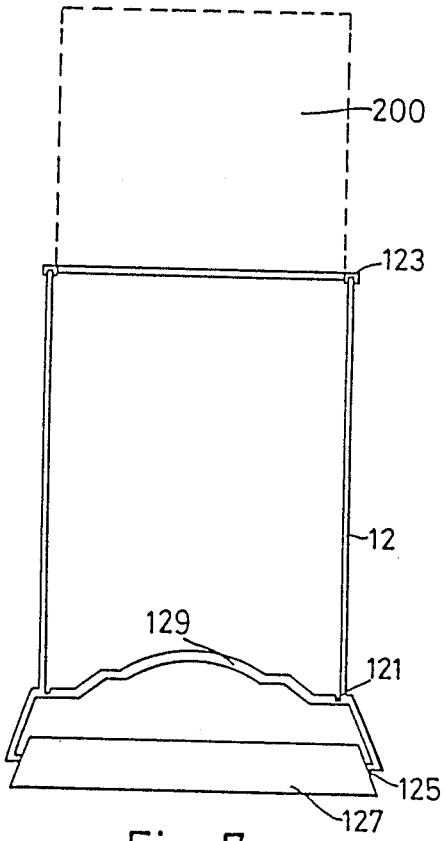
FIG. 7 shows a vertical cross section through the outer box member illustrating a second embodiment of the invention.
Figure 9A:
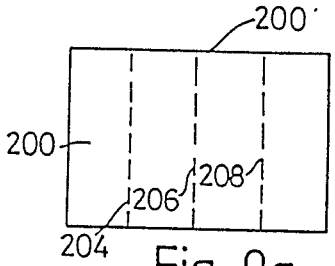
Figure 9B:
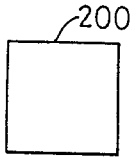
Figure 8A:
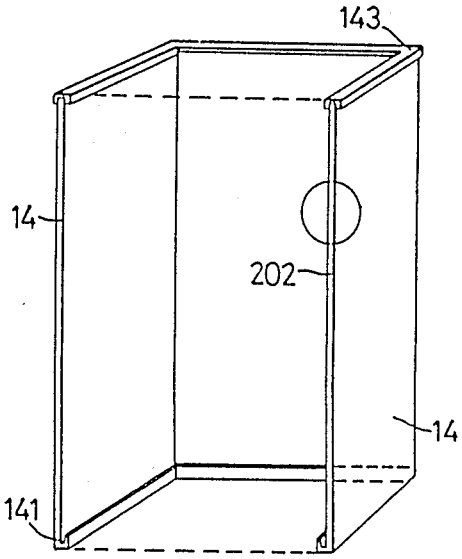
Figure 8B:
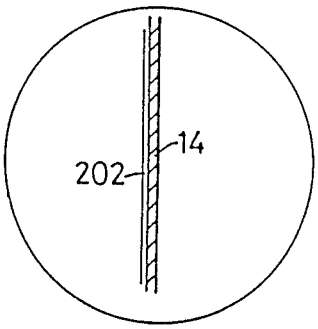

FIGS. 8*a* and 8*b* show a vertical cross section through an inner box member illustrating the second embodiment of the invention; and FIGS. 9*a* and 9*b* show cards suitable for the embodiments of FIGS. 7 and 8.

Figure 1:
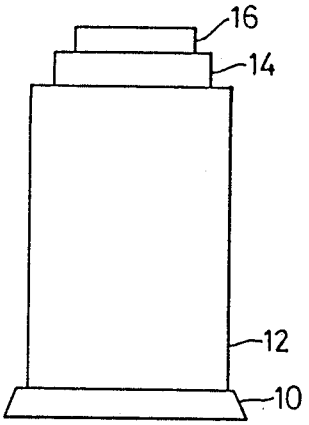
FIG. 1 shows a front elevation view of a first embodiment of the display system according to the present invention.

With reference now to FIG. 1, the display system comprises a base member 10 on which is mounted a first hollow box or tube 12. Within the tube 12 is positioned a second tube 14 and within this is positioned a third tube 16. Tube 12 is preferably permanently fixed, for example, by glueing to base 10.

Figure 2:
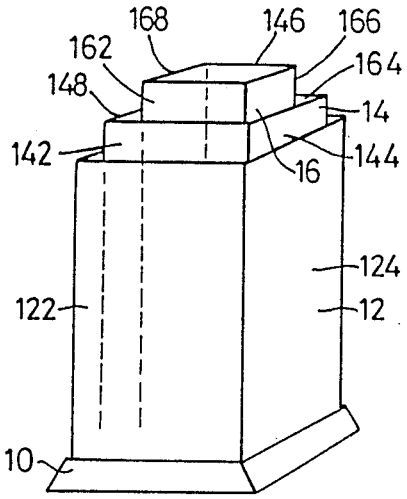
FIG. 2 shows a perspective cut away view of the display system of FIG. 1.

With reference now to FIG. 2 the tubes 12, 14, 16 are dimensioned such that tubes 14 and 16 may be slidably removed from tube 12. Tube 12 is preferably between 4 to 6 inches in cross-sectional width and therefore tubes 14 and 16 are correspondingly smaller. It is therefore possible to remove either tube 14 or tube 16 without disturbing the other tubes.

Figure 3:
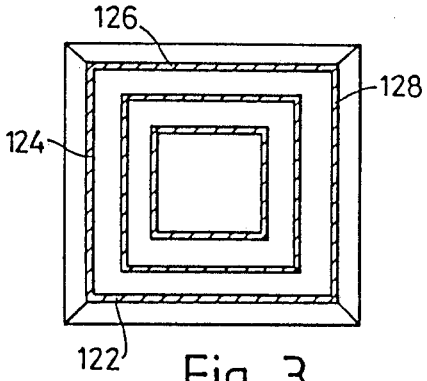
FIG. 3 shows the display system of FIG. 1 in plan view.

Tubes 12, 14 and 16 may as shown in FIG. 3 be of substantially square cross-section thereby presenting four elongate faces on which information relevant to a customer's needs may be displayed.

If the display system is used to display information relating to a menu for a restaurant then the outer faces 122, 124, 126 and 128 of tube 12 can, for example, be used to display advertising information, the outer surfaces 142, 144, 146 and 148 of tube 14 can be used to display information relating to food and the outer faces 162, 164, 166 and 168 of tube 16 can be used to display information relating to wines and other drinks etc.

Thus, the "menu" can be shared by two or more people, one reading the drinks section, one the food section and one reading the advertising. Since the area for information relates to the cross-section and thereby the peripheral distance of each tube and also its height a variation in formation displayed can be provided by altering one or more of the dimensions. For preference the tubes are of square or substantially square cross-section but since tubes 14 and 16 are of different crosssection then more information can be placed on tube 14. The information is preferably in printed sheet form (plastic or paper) and is stuck onto the sides of the tubes.

The size of the display can be selected to suit any particular purpose but for a table display the base size is preferably between four to six inches square and the height between six to eight inches or so to give aesthetic appeal.

Figure 4:
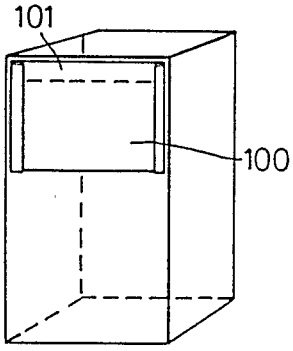
FIG. 4 shows a perspective view of a part of the display system of FIG. 1 in greater detail.
Figure 5:
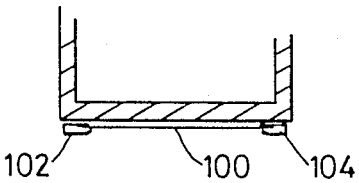
FIG. 5 shows a plan view of a portion of FIG. 5 in greater detail.

In an alternative embodiment illustrated in FIGS. 4 and 5 provision is made, preferably on one or both of the inner tubes 14, 16 for an interchangeable section of display. This can be used to display up to date information, for example, a "Dish of the Day" or "Wine of the Day". The information is printed or handwritten on a card 100 of paper or plastic which is inserted between sprung holding members 102, 104. As shown in FIG. 5 the members 102, 104 may be identical but positioned to be of opposite hand and may comprise an elongate strip of resilient plastics material generally G-shaped which holds the card 100 in a correctly oriented manner.

The card 100 may therefore be readily replaced and the top portion 101 of the card may be readily seen by a customer since it may be positioned above the top edge of the surrounding tube (12 or 14).

Preferably the interchangeable section is provided on tube 14 since there is more width for the information to be handwritten.

More than one interchangeable section may be provided on two or more faces of a tube or on both tubes 14 and 16 for example to display "Dish of the Day" and "Wine of the Day".

Figure 6:
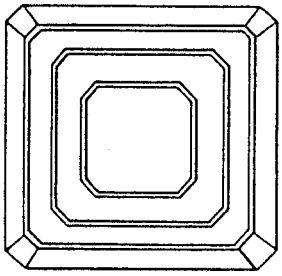
FIG. 6 shows in plan view an alternative embodiment.

With reference now to FIG. 6 the design is modified to a hexagon shape by "chamfering" the corners. This produces a different, possibly more pleasing design but does not substantially reduce the width of the display area on each side.

It is possible to modify the display system to a triangular shape but this reduces the area for display within a defined base width. Also a six sided display can be used but again the width of each side is reduced thereby restricting the length of each line of information for a given base size. A circular cross-section could also be used but the reading of information by a customer is not easy and this shape is not preferred.

Thus, the preferred shape is of substantially rectangular (in particular square) cross-section and the preferred number of tubes is three with either of the two inner tubes being removable singly. If required the innermost tube 16 may be closed at one or both ends to form a box if no other tube is required to be fitted within it.

With reference now to FIGS. 7, 8*a* and 8*b* in an alternative embodiment the information may be contained on one or more cards 200, 202 which may be placed inside each tube 12, 14 or 16, the tubes being transparent so that the information can be read through the tube walls. A preferred method of holding the cards inside the tubes is shown for both the outer tube 12 (FIG. 7) and for inner tubes such as 14 or 16 (FIGS. 8*a* and 8*b*).

With reference to FIGS. 9*a* and 9*b* each card 200, 202 may comprise a rectangular sheet of card with three scored lines 204, 206, 208 so that the card may be readily bent to form (in plan view), a square as shown in FIG. 9*b*. Information may be printed on each face of the card. The card is sized so that when folded into the form shown in FIG. 9*b* it may be slid down the centre of tubes 12, 14, 16 as shown in dotted form in FIG. 7.

The card may be held in outer tube 12 by cutting, or providing a slot 121 around the base of the box section, the bottom edges of the card thereby being trapped against horizontal movement. To restrain the card from being removed from the box a snap-on rim 123 is provided which also restrains the card from movement in the horizontal direction. The card 200 is therefore held securely with its faces adjacent the inner surfaces of the tube 12, the printed matter on the card being easily readable through the transparent tube. See also inset detail of card 202 and tube 14 shown in FIG. 8*b*.

With reference to FIG. 8*a* card 202 is similarly held by providing an upturned internal ledge 141 on the bottom of tube 14 and a similar snap-on rim 143.

With reference to FIG. 7 the base member 10 of the outer tube 12 may be fabricated as shown and may comprise a member 127 which is separate from the tube 12 and may be snapped into position as indicated past small abutments 125. This enables for example the tube 12 to be of plastics material and the member 127 to be of a heavier weight material e.g. hard rubber to give the display stability.

It may be seen that cards such as 200, 202 may be readily printed and dispatched through the post in the flat form shown in FIG. 9*a* and then folded into the form shown in FIG. 9*b* at remote restaurants, public houses etc. thereby allowing a central control of the menus in, for example, hotel chains.

Though the cards 200, 202 are shown foldable to produce the square, rectangular or hexagonal form as in FIG. 9*b* (only square illustrated) the cards may be made to cover only one face of the tube.

The card would however only be held at the top and bottom edges. To hold the card in the vertical plane suitable additional ledges are required on each internal vertical edge. This would add to the complexity of the tube and is not therefore preferred.

To centralise the tubes 14, 16 within the outer tube 12 the base of the outer tube 12 may be provided as shown in dotted outline with a mound 129. The mound may be as shown with a smooth face or may be castellated to provide stepped ledges sized to fit the tubes 14. 16.

I claim:

1. A display system for the display of information to a customer including a first hollow box section tube fixed to a base and including at least one further box section tube of smaller cross-section fitted within the first hollow box section tube to be readily removable therefrom and in which information relating to a customer's requirements is displayed on at least one face of each of the tubes, in which each tube is provided with means for retaining a card within the tube, in which the card is printed with information for the customer, each tube being transparent such that information on the card may be read through the tube, in which the card is replaceably retained within the tube and in which each tube is provided with means for retaining the card within close proximity to the inside surfaces of the tube.

2. A display system as claimed in claim 1 in which within the first hollow box section tube there are provided second and third further box section tubes, the second tube being sized to fit within the first tube and the third tube being sized to fit within the second tube.

3. A display system as claimed in claim 2 in which either of the second or third tubes may be removed from within the first tube without disturbing the other.

4. A display system as claimed in claim 2 in which the tubes are of rectangular cross-section.

5. A display system as claimed in claim 4 in which the tubes are of square cross-section.

6. A display system as claimed in claim 2 in which the tubes are of hexagonal cross-section.

7. A display system as claimed in claim 6 in which the hexagon is irregular with four broad faces and four interconnecting narrow faces.

8. A display system as claimed in claim 1 in which the faces of the tubes are covered with information relating to a customers requirements.

9. A display system as claimed in claim 8 in which one or more of the faces of the tubes is provided with means for holding temporarily information related to recent changes.

10. A display system as claimed in claim 1 in which the first hollow box section tube is provided with centering means to assist in centering the inner tube or tubes.

11. A display system as claimed in claim 1 in which the means for retaining the card within close proximity to the tube includes a snap on rim at the top of each tube, the snap on rim serving to retain the upper edges of the card in close proximity to the top of each tube.

12. A display system as claimed in claim 1 in which the means for retaining the card within close proximity to the tube includes an upturned internal ledge situated at the bottom edge of each tube.

13. A readily movable display system for standing on a table top for displaying information to a customer, said display system comprising:

a first transparent hollow box section tube fitted to a base;

said base being sized to fit on said table top;

at least one further transparent hollow box section tube of smaller cross-section fitted within the first hollow box section tube and readily removable therefrom;

information cards to be inserted in said tubes for displaying information relating to said customer's requirements on the faces of said tubes;

each information card being sized to fit within a respective one of said tubes and to display said information on each face of said respective one of said tubes;

said information on a respective card being readable through said respective one of said transparent tubes; and each tube having means for replaceably retaining a respective one of said cards within the tube and holding said respective card within close proximity to inside surfaces of said tube.

14. A display system according to claim 13 wherein said retaining and holding means includes a snap on rim at the top of each tube, said snap on rim serving to retain the upper edges of a respective information card in close proximity to the top of a respective tube.

15. A display system according to claim 13 wherein said retaining and holding means includes an upturned internal ledge situated at a bottom edge of respective ones of said tubes.

* * * * *